US011641936B2

(12) United States Patent
Phillips

(10) Patent No.: US 11,641,936 B2
(45) Date of Patent: May 9, 2023

(54) FIREARM STORAGE FURNISHING SYSTEM

(71) Applicant: Mike Phillips, Ogden, UT (US)

(72) Inventor: Mike Phillips, Ogden, UT (US)

( * ) Notice: Subject to any disclaimer, the term of this patent is extended or adjusted under 35 U.S.C. 154(b) by 0 days.

(21) Appl. No.: 17/385,100

(22) Filed: Jul. 26, 2021

(65) Prior Publication Data

US 2022/0232971 A1 Jul. 28, 2022

Related U.S. Application Data

(60) Provisional application No. 63/142,912, filed on Jan. 28, 2021.

(51) Int. Cl.
*A47B 81/00* (2006.01)
*F41C 33/06* (2006.01)

(52) U.S. Cl.
CPC ..... *A47B 81/005* (2013.01); *F41C 33/06* (2013.01)

(58) Field of Classification Search
CPC ..... A47B 81/005; A47B 81/00; F41C 33/06
See application file for complete search history.

(56) References Cited

U.S. PATENT DOCUMENTS 3,008,617 A * 11/1961 Villwock ..... F41C 33/0209 224/183
3,009,225 A * 11/1961 Budreck ..... H01F 7/0252 24/303
3,109,619 A * 11/1963 Krug ..... A47K 1/09 248/690
3,245,165 A * 4/1966 Roberta ..... G09F 7/18 248/467
3,372,443 A * 3/1968 Daddona, Jr. ..... A41F 1/002 24/303
3,618,174 A * 11/1971 Schainholz et al. .. H01F 7/0263 24/373
3,707,250 A * 12/1972 Esposito ..... F41C 33/0227 42/106
3,827,021 A * 7/1974 Phelon ..... A47J 47/16 248/309.4
3,938,717 A * 2/1976 Theodore ..... F42B 39/00 224/678
4,021,891 A * 5/1977 Morita ..... A45C 13/1069 24/303
4,155,608 A * 5/1979 Orlewicz ..... F21V 23/04 109/51
4,165,826 A * 8/1979 Chica ..... F41C 33/048 224/191
4,265,002 A * 5/1981 Hosken ..... A41F 1/002 24/303
4,318,503 A * 3/1982 Capano ..... F41C 33/0263 D3/222

(Continued)

*Primary Examiner* — Stanton L Krycinski

(57) ABSTRACT

A firearm storage furnishing system may be provided comprising a substrate body having a coupling portion and a base portion that may be affixed to one another via an angled joint. The coupling portion may comprise a smaller surface area than the base portion. The coupling portion may comprise a magnetic coupling element disposed at a central area of the coupling portion. The magnetic coupling element may comprise a protective exterior coating, a support substrate, a magnet comprising an adequate orthogonal pulling force, and a central aperture disposed through the protective exterior coating, the support substrate and the magnet.

20 Claims, 3 Drawing Sheets

(56) References Cited

U.S. PATENT DOCUMENTS 4,337,860 A * 7/1982 Carrigan ..... B25H 3/003 211/49.1
4,453,294 A * 6/1984 Morita ..... E05C 19/16 24/66.1
4,455,719 A * 6/1984 Morita ..... E05C 19/16 24/303
4,458,395 A * 7/1984 Aoki ..... E05C 19/16 24/303
4,458,396 A * 7/1984 Aoki ..... E05C 19/16 24/303
4,480,361 A * 11/1984 Morita ..... A45C 13/1069 24/66.1
4,700,436 A * 10/1987 Morita ..... A45C 13/1069 24/303
4,779,314 A * 10/1988 Aoki ..... A41F 1/002 24/303
4,825,526 A * 5/1989 Shenier ..... A41F 1/002 24/303
4,875,654 A * 10/1989 Chandonnet ..... F16B 3/00 248/467
4,890,466 A * 1/1990 Cislo ..... F41C 33/06 109/51
4,941,235 A * 7/1990 Aoki ..... A45C 13/1069 24/303
4,989,299 A * 2/1991 Morita ..... A44C 5/2071 24/303
4,991,270 A * 2/1991 Aoki ..... A45C 13/1069 24/303
5,042,116 A * 8/1991 Ossiani ..... A45C 13/1069 24/303
5,108,019 A * 4/1992 Woodward ..... F41C 33/04 340/568.2
5,125,134 A * 6/1992 Morita ..... E05C 19/16 24/303
5,142,746 A * 9/1992 Morita ..... A45C 13/1069 24/303
5,152,035 A * 10/1992 Morita ..... A41F 1/002 24/303
5,208,951 A * 5/1993 Aoki ..... H01F 7/0263 24/303
5,249,338 A * 10/1993 Aoki ..... H01F 7/0263 24/303
5,251,362 A * 10/1993 Riceman ..... H01F 7/0263 24/303
5,294,031 A * 3/1994 Volpei ..... F41C 33/048 224/664
5,400,479 A * 3/1995 Medina ..... H01F 7/0263 24/303
5,409,153 A * 4/1995 Ristich ..... A45C 1/04 D3/238
5,448,806 A * 9/1995 Riceman ..... H01F 7/0263 24/303
5,473,799 A * 12/1995 Aoki ..... E05C 19/16 24/66.1
5,525,966 A * 6/1996 Parish ..... G08B 21/02 340/568.1
5,572,773 A * 11/1996 Bauer ..... A41F 1/002 24/303
5,621,996 A * 4/1997 Mowl, Jr. ..... F41A 17/063 42/70.07
5,675,874 A * 10/1997 Chen ..... A45C 13/1069 24/303
5,695,165 A * 12/1997 Moriarty ..... B01L 9/54 248/206.5
5,743,394 A * 4/1998 Martin ..... B25H 3/003 211/DIG. 1
5,855,285 A * 1/1999 Laird ..... B25H 3/003 206/378
5,881,787 A * 3/1999 Davis ..... A45C 13/1069 150/118
5,953,795 A * 9/1999 Bauer ..... A41F 1/002 24/303
5,983,464 A * 11/1999 Bauer ..... H01F 7/0263 24/303
5,987,715 A * 11/1999 Khon ..... A45C 13/1069 24/66.1
5,992,807 A * 11/1999 Tarulli ..... B60R 11/0241 379/454
6,101,688 A * 8/2000 Marchesi ..... A45C 13/1069 24/303
6,170,131 B1 * 1/2001 Shin ..... A41F 1/002 24/66.1
6,182,336 B1 * 2/2001 Bauer ..... A41F 1/002 24/66.1
6,215,381 B1 * 4/2001 Aoki ..... A45C 13/1069 335/207
6,264,079 B1 * 7/2001 Skaggs ..... F41C 33/041 D3/222
6,295,702 B1 * 10/2001 Bauer ..... A45C 13/1069 24/303
6,304,162 B1 * 10/2001 Nakatsuka ..... H01F 41/028 335/302
6,434,801 B2 * 8/2002 Grunberger ..... A41F 1/002 24/66.1
6,473,946 B1 * 11/2002 Cheng ..... A41F 1/002 24/303
6,796,344 B2 * 9/2004 Chen ..... A45C 3/06 150/113
6,811,127 B1 * 11/2004 Shiao ..... B25H 3/04 211/DIG. 1
6,888,940 B1 * 5/2005 Deppen ..... B60R 11/0241 379/454
7,097,144 B2 * 8/2006 Kohno ..... A47G 25/0607 248/683
7,735,645 B2 * 6/2010 Joyce ..... B25H 3/04 211/DIG. 1
7,806,309 B2 * 10/2010 Korchmar ..... A45F 3/14 224/183
8,328,058 B2 * 12/2012 Wilson ..... A45F 3/005 224/675
8,622,269 B2 * 1/2014 Hogue ..... F41C 33/048 224/587
8,646,971 B2 * 2/2014 Doyle ..... B65D 33/24 383/38
9,009,870 B1 * 4/2015 Connick, Jr. ..... A41D 27/20 2/252
9,265,319 B1 * 2/2016 Zeh-Franke ..... F41C 33/0209
9,500,440 B2 * 11/2016 Gordon ..... F41C 33/041
9,568,275 B2 * 2/2017 Sykes ..... F41C 33/0236
9,777,988 B2 * 10/2017 Karcher ..... F41C 33/041
9,784,530 B1 * 10/2017 Myers ..... F41C 33/0227
9,891,021 B2 * 2/2018 Galoob ..... F41C 33/0236
10,141,092 B2 * 11/2018 Bennett ..... H01F 7/021
10,159,330 B2 * 12/2018 Kovac ..... A45C 15/00
10,168,121 B2 * 1/2019 Gordon ..... F41C 33/048
10,222,174 B2 * 3/2019 Robertson ..... F41C 33/041
10,415,928 B2 * 9/2019 Jwszenski ..... F41C 33/048
10,773,654 B2 * 9/2020 Adrain ..... B60R 7/14
10,843,328 B2 * 11/2020 Wacker ..... B25H 3/04
10,962,326 B2 * 3/2021 Mills ..... F41C 33/048
11,000,113 B2 * 5/2021 Salvitti ..... B26B 29/025
11,002,510 B2 * 5/2021 Sitz ..... F41C 33/041
11,051,598 B2 * 7/2021 Grunberger ..... A45C 13/1069
11,112,211 B1 * 9/2021 Watson ..... A45F 3/005
2002/0095751 A1 * 7/2002 Reiter ..... H01F 7/0263 24/303
2004/0217141 A1 * 11/2004 Brooks ..... F41C 33/0218 224/660
2006/0032876 A1 * 2/2006 Goffinet ..... B25H 3/00 224/183
2007/0000965 A1 * 1/2007 Cannon ..... F41C 33/048 224/238
2011/0192810 A1 * 8/2011 Kao ..... B25H 3/028 211/70.6
2011/0280499 A1 * 11/2011 Brundage ..... A45F 5/06 224/183
2012/0190413 A1 * 7/2012 Ojeda ..... A45F 5/021 455/575.8

(56) References Cited

U.S. PATENT DOCUMENTS

| | | | | |
|---|---|---|---|---|
| 2012/0292354 | A1* | 11/2012 | Baxley | F41C 33/0218 224/192 |
| 2014/0224847 | A1* | 8/2014 | Miller | F41C 33/04 224/183 |
| 2015/0362285 | A1* | 12/2015 | Gazso | A45C 1/02 150/102 |
| 2016/0223290 | A1* | 8/2016 | Jacob | F41C 33/06 |
| 2017/0292810 | A1* | 10/2017 | Thompson | F41C 33/041 |
| 2018/0135939 | A1* | 5/2018 | Tedder | F41C 33/0209 |
| 2020/0386514 | A1* | 12/2020 | Yeates | F41C 33/0218 |
| 2021/0404766 | A1* | 12/2021 | Reese, Jr. | F41C 33/04 |
| 2022/0205757 | A1* | 6/2022 | Moore | F41C 33/06 |

* cited by examiner

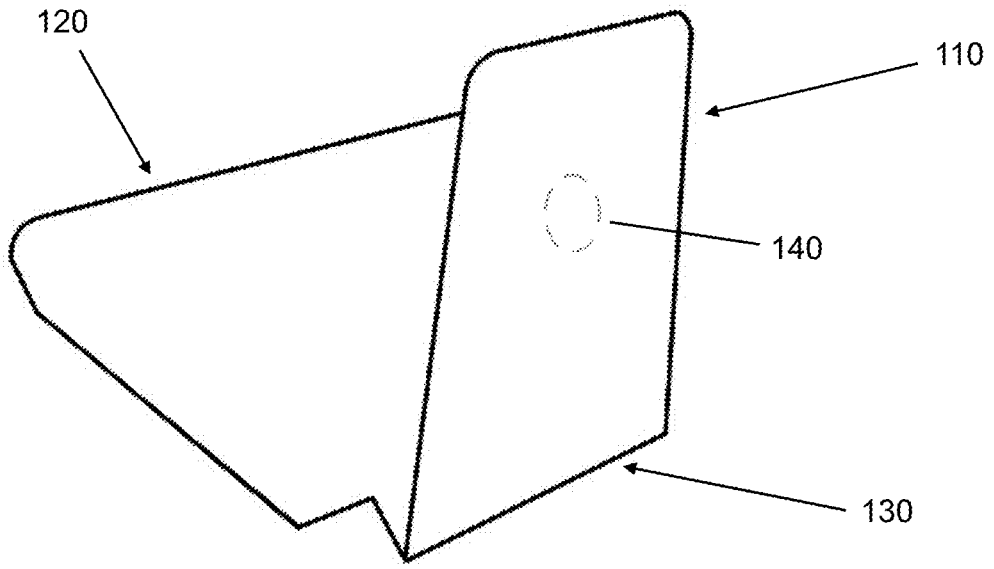
Figure 1 100
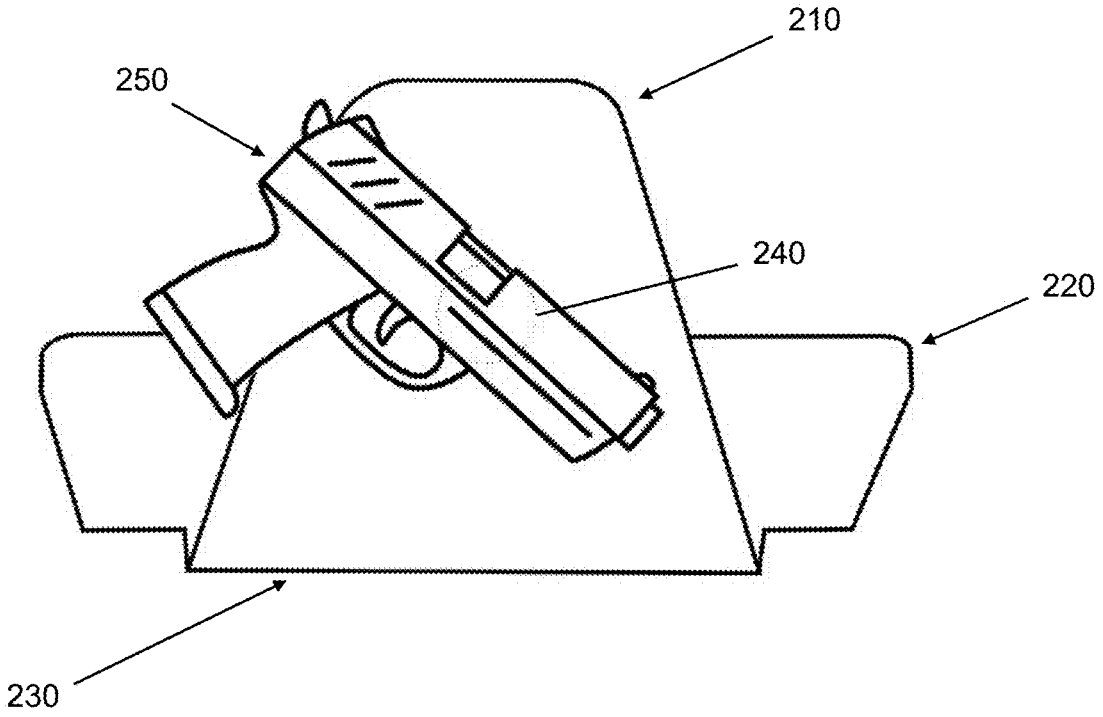
200 Figure 2

FIREARM STORAGE FURNISHING SYSTEM

CROSS-REFERENCE TO RELATED APPLICATIONS

This application claims priority to U.S. Provisional Patent Application Ser. No. 63/142,912, entitled "Firearm Storage Furnishing System," filed Jan. 28, 2021. The contents of this application are hereby incorporated by reference in their entirety.

BACKGROUND OF THE INVENTION

From its creation, firearms have been woven into the fabric of American society and continue to be utilized for both recreation and protection. As of 2020, roughly 42 percent of all US households reported owning at least one firearm. The US firearm industry produces roughly 10 million firearms annually and accounts for roughly $60 billion in domestic sales each year. The number of background checks performed for those seeking to purchase a firearm doubled from 20 million in 2012 to 40 million in 2020.

One of the primary reasons individuals desire to purchase firearms is the protection of life and personal property from criminals. From the years 2003-2007, an average of 3.7 million home invasions occurred each year with the homeowner being present in roughly 1 million of those instances and became victims of violence roughly 25% of the time. Roughly 12% of all home invasions involved the perpetrator wielding a firearm.

Presently, a home invasion occurs once every 30 seconds in the United States and the average loss from such an occurrence is roughly $3,000 without factoring the mental and emotional harm stemming therefrom. Further, home invasion statistically is the most feared crime with 58% reporting that they specifically fear a break-in while they are sleeping. Additionally, rural areas are statistically much more likely to experience a break-in than densely-populated areas.

Therefore, it would be advantageous to provide a product that allows a firearm owner to store their firearm in a conveniently accessible location. Further, it would be advantageous to provide a product that allows a firearm owner to quickly access their firearm while they are in bed. Additionally, it would be advantageous to provide a product that allows a firearm owner to removably store their firearm in any furnishing where the owner would like to conveniently access their firearm. It would further be advantageous to provide a product that allows a firearm owner to conveniently store the product when not in use.

BRIEF DESCRIPTION OF THE DRAWINGS

FIG. 1 illustrates a perspective view of a firearm storage furnishing system in accordance with some embodiments of the present invention.

FIG. 2 illustrates an overview of a firearm storage furnishing system utilizing a magnetic element to retain a firearm in accordance with some embodiments of the present invention.

DETAILED DESCRIPTION OF THE INVENTION

Figure 3A:
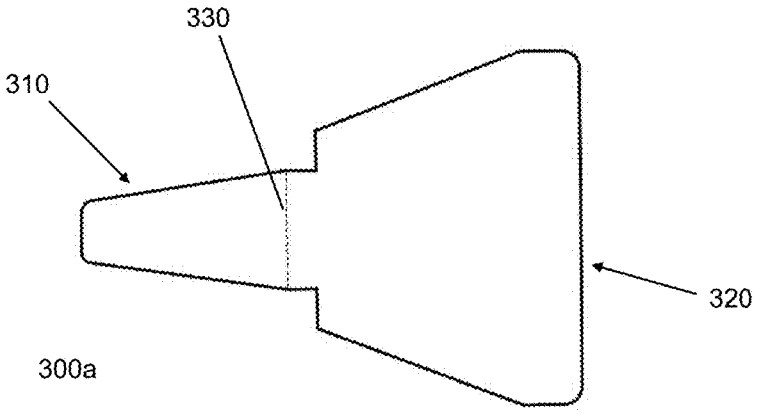
FIG. 3A illustrates a plan view of a firearm storage furnishing system in an extended state in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a firearm storage furnishing system" also includes a plurality of firearm storage furnishing systems and the like.

In some embodiments, a firearm storage furnishing system is provided, comprising a substrate body having a coupling portion and a base portion that are affixed to one another via an angled joint, wherein the coupling portion comprises a smaller surface area than the base portion; and the coupling portion comprises a magnetic coupling element disposed at a central area of the coupling portion.

In some embodiments, the magnetic coupling element comprises a protective exterior coating, a support substrate, a magnet and a central aperture.

In some embodiments, the magnetic coupling element comprises a planar shape with a surface area of at least 1 square inch and a vertical pulling force of between 25 pounds and 40 pounds.

In some embodiments, the magnet comprises an orthogonal pulling force that creates a frictional force of at least 3 pounds between the magnetic coupling element and a firearm exterior surface when the magnetic coupling element is oriented vertical relative a ground surface.

In some embodiments, the magnet is fabricated from one or more materials including iron, aluminum, nickel, cobalt, samarium, dysprosium, neodymium, boron, strontium, barium, praseodymium, hafnium, zirconium and any combinations thereof.

In some embodiments, the central aperture is disposed through the protective exterior coating, the support substrate and the magnet and comprises an exterior aperture portion having a diameter that is 1.5 to 2.5 times greater than a diameter of an interior aperture portion of the central aperture.

In some embodiments, the coupling portion comprises a recess fabricated into an exterior surface thereof, and wherein the recess is shaped to accept the magnetic coupling element which is secured thereto by inserting a fastening element into the central aperture such that the fastening element is disposed below an exterior surface of the magnetic coupling portion.

In some embodiments, the substrate body and the support substrate are each fabricated from one or more materials including a powder coated metal, a steel alloy, aluminum, a polymer and any combinations thereof.

In some embodiments, the protective exterior coating comprises one or more materials including polytetrafluoroethylene, polyimide, polyetheretherketone, polyphenylensulfide, nylon, acetal, rubber, polyester and any combinations thereof.

In some embodiments, the base portion and the coupling portion each comprises a convex isosceles trapezoidal shape.

In some embodiments, the ratio of the surface area of the base portion to the surface area of the coupling portion is between 1.5 and 2.5.

In some embodiments, the magnetic coupling element is embedded within an outer surface of the coupling portion.

In some embodiments, the magnetic coupling portion is movable across an outer surface of the coupling portion.

In some embodiments, the angled joint comprises a hinge that rotates through an angle of at least 90 degrees.

In some embodiments, the base portion comprises one or more high friction materials disposed upon an exterior surface thereof.

In some embodiments, the magnetic coupling element comprises: a protective exterior coating fabricated from one or more materials including polytetrafluoroethylene, polyimide, polyetheretherketone, polyphenylensulfide, nylon, acetal, rubber, polyester and any combinations thereof; a support substrate fabricated from one or more materials including a powder coated metal, a steel alloy, aluminum, a polymer and any combinations thereof; a magnet comprising an orthogonal pulling force that creates a frictional force of at least 3 pounds between the magnetic coupling element and a firearm exterior surface when the magnetic coupling element is oriented vertical relative a ground surface; and a central aperture disposed through the protective exterior coating, the support substrate and the magnet.

In some embodiments, the magnetic coupling element comprises: a protective exterior coating fabricated from one or more materials including polytetrafluoroethylene, polyimide, polyetheretherketone, polyphenylensulfide, nylon, acetal, rubber, polyester and any combinations thereof; a support substrate fabricated from one or more materials including a powder coated metal, a steel alloy, aluminum, a polymer and any combinations thereof; a magnet comprising an orthogonal pulling force of between 25 pounds and 40 pounds; and a central aperture disposed through the protective exterior coating, the support substrate and the magnet.

In some embodiments, the magnetic coupling element comprises: a protective exterior coating fabricated from one or more materials including polytetrafluoroethylene, polyimide, polyetheretherketone, polyphenylensulfide, nylon, acetal, rubber, polyester and any combinations thereof; a support substrate fabricated from one or more materials including a powder coated metal, a steel alloy, aluminum, a polymer and any combinations thereof; a magnet comprising an orthogonal pulling force of between 25 pounds and 40 pounds that creates a frictional force of at least 3 pounds between the magnetic coupling element and a firearm exterior surface when the magnetic coupling element is oriented vertical relative a ground surface; and a central aperture disposed through the protective exterior coating, the support substrate and the magnet, wherein the central aperture comprises an exterior aperture portion having a diameter greater than a diameter of an interior aperture portion of the central aperture.

In some embodiments, a firearm storage furnishing system, comprising: a substrate body having a coupling portion and a base portion that are affixed to one another via an angled joint, wherein the coupling portion comprises a smaller surface area than the base portion; and the coupling portion comprises a magnetic coupling element disposed at a central area of the coupling portion, wherein the magnetic coupling element comprises: a protective exterior coating; a support substrate; a magnet comprising an orthogonal pulling force of between 25 pounds and 40 pounds; and a central aperture disposed through the protective exterior coating, the support substrate and the magnet.

In some embodiments, a firearm storage furnishing system, comprising: a substrate body having a coupling portion and a base portion that are affixed to one another via an angled joint at an angle of between 80 degrees and 100 degrees, wherein the coupling portion comprises a smaller surface area than the base portion and the ratio of the surface area of the base portion to the surface area of the coupling portion is between 1.5 and 2.5; and the coupling portion comprises a magnetic coupling element disposed within an outer surface of the coupling portion and at a central area of the coupling portion, wherein the magnetic coupling element comprises: a protective exterior coating fabricated from one or more materials including polytetrafluoroethylene, polyimide, polyetheretherketone, polyphenylensulfide, nylon, acetal, rubber, polyester and any combinations thereof; a support substrate fabricated from one or more materials including a powder coated metal, a steel alloy, aluminum, a polymer and any combinations thereof; a magnet comprising an orthogonal pulling force of between 25 pounds and 40 pounds that creates a frictional force of at least 3 pounds between the magnetic coupling element and a firearm exterior surface when the magnetic coupling element is oriented vertical relative a ground surface; and a central aperture disposed through the protective exterior coating, the support substrate and the magnet, wherein the central aperture comprises an exterior aperture portion having a diameter greater than a diameter of an interior aperture portion of the central aperture.

Exemplary embodiments of the present invention are illustrated in the accompanying figures. As shown in FIG. 1, a perspective view of a firearm storage furnishing system 100 is provided. The firearm storage furnishing system 100 may comprise a coupling portion 110 fabricated adjacent to a base portion 120 via an angled joint 130. The coupling portion 110 may preferably have a smaller surface area than the base portion 120. The smaller surface area of the coupling portion 110 allows for a firearm to be coupled thereto while extending outside of the dimensions thereof, as shown in FIG. 2, to allow an individual to easily grip and draw the firearm without the coupling portion 110 interfering therewith. Further, the larger surface area of the base portion 120 allows for increased contact with a furnishing article and thereby increased frictional force therewith which prevents the firearm storage furnishing system 100 from being removed from the furnishing article while the individual is rapidly drawing the firearm from the coupling portion 110.

The coupling portion 110 may be secured to the base portion 120 such that each portion 110, 120 may rotate relative one another. Alternatively, the coupling portion 110 may be secured to the base portion 120 such that each portion 110, 120 may be permanently affixed at a single angle relative one another. In the permanently affixed configuration, the coupling and base portions 110, 120 may be affixed together via welding, unitary fabrication, injection molding and the like.

If the coupling portion 110 is allowed to rotate relative the base portion 120, then the angled joint 130 may function as a hinge with a plurality of operating positions. Specifically, the angled joint 130 in the hinge configuration may take an extended operating position, a folded operating position and a rotating operating position. For instance, the angled joint 130 hinge in the extended operating position is illustrated in FIG. 1. The angled joint 130 hinge is configured in the folded operating position when the hinge allows the coupling portion 110 to lay adjacent and parallel the base portion 120. The angled joint 130 hinge is configured in the rotating operating position when the hinge allows the coupling portion 110 to rotate between the extended operating position and the folded operating position. The angled joint 130 hinge may allow the coupling portion 110 and the base portion 120 to rotate through an angle of at least 90 degrees relative one another.

The firearm storage furnishing system 100 may further comprise a magnetic coupling element 140. In one embodiment, the magnetic coupling element 140 may be embedded within the body of the coupling portion 110. In another embodiment, the magnetic coupling element 140 may be disposed upon an exterior surface of the coupling portion 110. In this configuration, the magnetic coupling element 140 may be movable across the exterior surface of the coupling portion 110 as desired by an individual using the firearm storage furnishing system 100.

Further, in this configuration, the magnetic coupling element 140 is preferably disposed upon an outer surface of the coupling portion 110 that is opposite the side of the base 120. When in use, the magnetic coupling element 140 may be utilized to secure a firearm to the outer surface of the coupling portion 110 to allow an individual using the firearm storage furnishing system 100 to retrieve the firearm from the outer surface and the magnetic coupling element 140 and return it thereupon. Additionally, in some embodiments, the base portion 120 may also comprise a magnetic coupling element 140 in order to allow the firearm storage furnishing system 100 to magnetically couple to complimentary surfaces at the base portion 120 when the system 100 is in the folded configuration to thereby allow the firearm to remain coupled to the coupling portion 110.

The magnetic coupling element 140 may take any suitable planar shape such as, but not limited to, circular, elliptical, triangular, square, rectangular, polygonal and the like or any combination thereof. Similarly, the magnetic coupling element 140 may have any suitable size dimensions but may be no larger than the length, width and thickness dimensions of the coupling portion 110 as illustrated in FIG. 1. Preferably, the surface area of the magnetic coupling element 140 may be at least 4 sq inches in order to accommodate typical magnetic material pulling forces. The magnetic coupling element 140 may be fabricated from any suitable magnetic materials including, but not limited to, iron, aluminum, nickel, cobalt, samarium, dysprosium, neodymium, boron, strontium, barium, praseodymium, hafnium, zirconium and the like or any combination thereof.

Further, the magnetic coupling element 140 may preferably provide a standard pull force of between 25 and 40 lbs in the direction orthogonal to the planar surface of the magnetic coupling element 140. A minimum of 25 lbs of vertical pulling force is adequate to retain the weight of a firearm that is to be coupled to the coupling portion 110 as shown in FIG. 2 given the weight of the average handgun is between 1.5 and 2.5 lbs fulled loaded. Additionally, this minimum vertical pulling force is also adequate to allow for an individual to remove the firearm from the coupling portion 110 via tangential force applied to the firearm across the surface of the coupling portion 110 which only requires a fraction of the magnetic coupling element's 140 vertical pulling force. Further, this minimum vertical pulling force ensures that the individual will be able to easily remove the firearm from the magnetic coupling element 140 in the event of an intruder emergency where rapid removal of the firearm from the coupling portion 110 is vital to the safety of the individual using the firearm as protection against the intruder causing the intruder emergency.

Moreover, a maximum of 40 lbs of vertical pulling force would still allow for the robust retention of the firearm to the coupling portion 110 and the rapid removal of the firearm therefrom. Further, magnetic coupling elements 140 having vertical pulling forces of greater than 40 lbs may more than adequately retain the firearm to the coupling portion 110, but may also prevent rapid removal of the firearm from the magnetic coupling element 140 which may jeopardize the safety of the individual attempting to use the firearm. Further, magnetic coupling elements 140 having vertical pulling forces of greater than 40 lbs may further increase the cost of fabricating the magnet and thereby the firearm storage furnishing system 100 as a whole. Therefore, it would be preferable to utilize a magnetic coupling element 140 having a vertical pulling force of between 25 and 40 lbs in the direction orthogonal to the planar surface of the magnetic coupling element 140.

As shown in FIG. 2, an overview of a firearm storage furnishing system 200 utilizing a magnetic coupling element 240 to retain a firearm 250 is provided. The firearm storage furnishing system 200 may comprise a coupling portion 210 fabricated adjacent to a base portion 220 via an angled joint 230. The coupling portion 210 may be secured to the base portion 220 such that each portion 210, 220 may rotate relative one another. Alternatively, the coupling portion 210 may be secured to the base portion 220 such that each portion 210, 220 may be permanently affixed at a single angle relative one another.

The firearm storage furnishing system 200 may further comprise a magnetic coupling element 240. In one embodiment, the magnetic coupling element 240 may be embedded within the body of the coupling portion 210. In another embodiment, the magnetic coupling element 240 may be disposed upon an exterior surface of the coupling portion 210. In this configuration, the magnetic coupling element 240 may be movable across the exterior surface of the coupling portion 210 as desired by an individual using the firearm storage furnishing system 200. Further, in this configuration, the magnetic coupling element 240 is preferably disposed upon an outer surface of the coupling portion 210 that is opposite the side of the base 220. When in use, the magnetic coupling element 240 may be utilized to secure a firearm 250 to the outer surface of the coupling portion 210 to allow an individual using the firearm storage furnishing system 200 to retrieve the firearm from the outer surface and the magnetic coupling element 240 and return it thereupon.

In the externally disposed configuration, the magnetic coupling element 240 may be covered with one or more protective coatings to prevent damage to the coupling portion 210, magnetic coupling element 240, and the aesthetic exterior of the firearm 250 from frictional abrasion therebetween. The one or more protective coatings may comprise low-friction materials such as, but not limited to, polytetrafluoroethylene, polyimide, polyetheretherketone, polyphenylensulfide, nylon, acetal, rubber, polyester and the like or any combination thereof. Preferably, the one or more protective coatings may comprise a thickness that is thin enough to prevent mitigation of the preferred vertical pulling force of the magnetic coupling element 240.

Similarly, the coupling portion 210 of the firearm storage furnishing system 200 may also comprise one or more protective coatings disposed on one or more of the exterior surfaces of the coupling portion 210 in order to prevent damage to the coupling portion 210, magnetic coupling element 240, and the aesthetic exterior of the firearm 250 from frictional abrasion therebetween. The one or more protective coatings disposed on the one or more exterior surfaces of the coupling portion 210 may comprise one or more layers of paint, powder coating, polytetrafluoroethylene, polyimide, polyetheretherketone, polyphenylensulfide, nylon, acetal, rubber, polyester and the like or any combination thereof.

The firearm 250 may be any suitable firearm having a form factor and weight that are compatible with the dimensions of the coupling portion 210 and the vertical pulling force of the magnetic coupling element 240. Preferably, the firearm 250 may be a handgun as shown in FIG. 2 given the dimensions of the coupling portion 210 illustrated and the aforementioned preferred range of vertical pulling forces of the magnetic coupling element 240. Additionally, while the firearm 250 may only comprise one coat of paint thereon, frictional abrasion between the coupling portion 210, the magnetic coupling element 240, and the firearm 250 may be prevented during use of the firearm storage furnishing system 200 via the aforementioned one or more protective coatings.

Further, the firearm 250 may be selectively secured to the coupling portion 210 by the individual via placing the firearm 250 into parallel orientation with the plane fo the coupling portion 210 and adjacent the magnetic coupling element 240. Similarly, the firearm 250 may be selectively removed from the coupling portion 210 by the individual via pulling the firearm 250 away from the magnetic coupling element 240 with a sufficient force so as to overcome the vertical pulling force thereof.

Preferably, the individual removes the firearm 250 from the coupling portion 210 by pulling the firearm 250 by its handle in a direction parallel with the plane of the coupling portion 210 away from the position of the magnetic coupling element 240. This method requires the individual to provide a reduced amount of removal force to the firearm 250 to effectuate its removal relative the method of the individual pulling the firearm 250 in a direction orthogonal to the plane of the coupling portion 210. Therefore, it is preferable that the individual secure the firearm 250 to the coupling portion 210 in a manner such that the firearm 250 is disposed parallel to the plane of the coupling portion 210.

As shown in FIG. 3A, a plan view of a firearm storage furnishing system 300*a* in an extended state is provided. The firearm storage furnishing system 300*a* may comprise a coupling portion 310 fabricated adjacent to a base portion 320 via an angled joint 330. The coupling portion 310 may be secured to the base portion 320 such that each portion 310, 320 may rotate relative one another. In this embodiment, the angled joint 330 may preferably function as a rotating hinge with a plurality of operating positions.

Specifically, the angled joint 330 may take an extended operating position, a folded operating position and a rotating operating position. For instance, the angled joint 330 in the extended operating position is illustrated in FIG. 3A. The angled joint 330 is configured in the folded operating position when the hinge allows the coupling portion 310 to lay adjacent and parallel the base portion 320. The angled joint 330 is configured in the rotating operating position when the hinge allows the coupling portion 310 to rotate between the extended operating position and the folded operating position. The angled joint 330 may preferably allow the coupling portion 310 and the base portion 320 to rotate through an angle of at least 90 degrees relative one another. The 90 degree rotation angle allows the angled joint 330 to rotate from the extended operating position through the rotating operating position to the folded operating position.

Figure 3B:
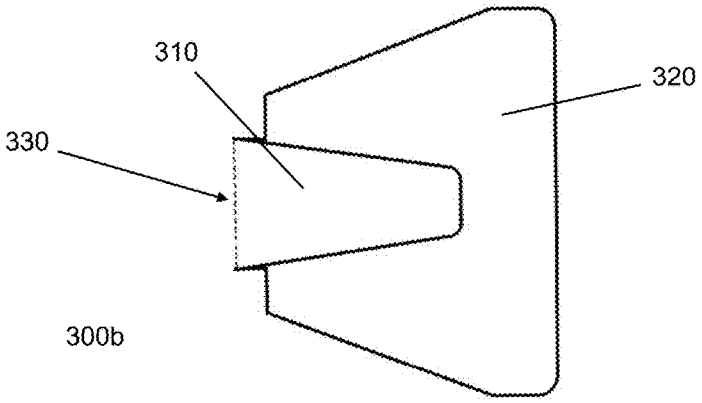
FIG. 3B illustrates a plan view of a firearm storage furnishing system in a folded state in accordance with some embodiments of the present invention.

As shown in FIG. 3B, a plan view of a firearm storage furnishing system 300*b* in a folded state is provided. The firearm storage furnishing system 300*b* may comprise a coupling portion 310 fabricated adjacent to a base portion 320 via an angled joint 330. The coupling portion 310 may be secured to the base portion 320 such that each portion 310, 320 may rotate relative one another. In this embodiment, the angled joint 330 may preferably function as a rotating hinge to allow the coupling portion 310 to be disposed parallel to the base portion 320 in the folded operating position.

When the coupling portion 310 and the base portion 320 rotate relative one another via the angled joint 330 to either of the extended operating position or the folded operating position, the angled joint 330 may lock the coupling portion 310 and the base portion 320 into that position. Locking into either position may involve selective locking such that additional force from the individual is required to manipulate the portions 310, 320 from their locked configuration in the extended or folded operating positions into the rotating operating position.

Alternatively, the locking functionality may not be utilized at all if the magnetic coupling element 340 is utilized to secure the coupling portion 310 to the base portion 320 in the folded position. Further, in this configuration, the angled joint 330 may be fabricated in such a way as to not allow the coupling portion 310 and the base portion 320 to rotate more than 90 degrees relative one another, thereby securing the portions 310, 320 in the extended position while the firearm storage furnishing system 300*b* is in use as illustrated in FIG. 4.

Figure 4:
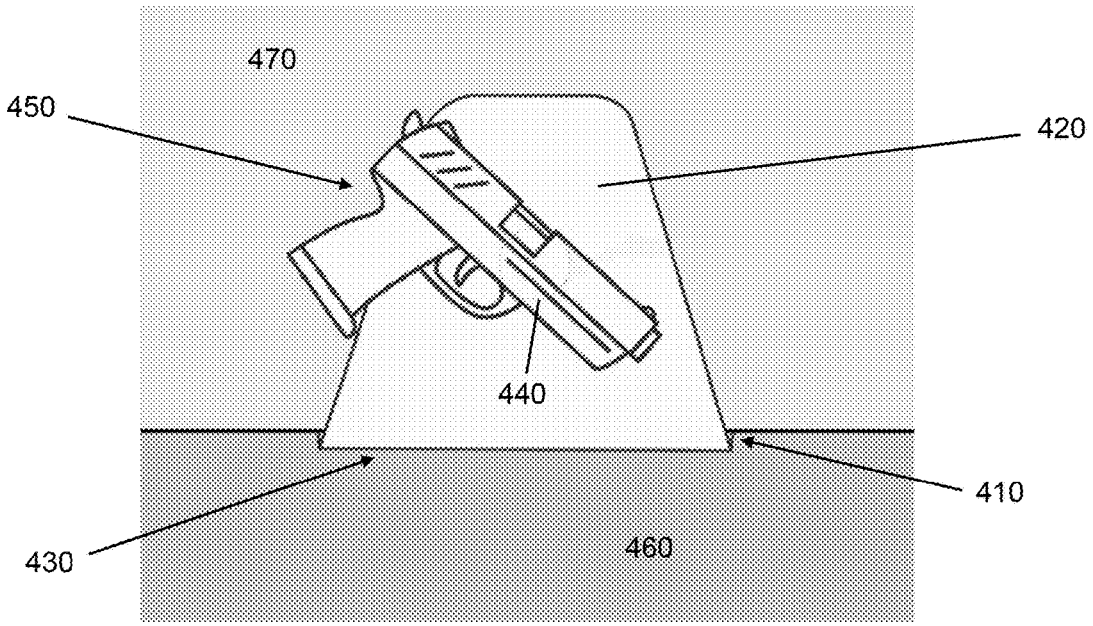
FIG. 4 illustrates an overview of a firearm storage furnishing system retaining a firearm while secured between top and bottom portions of a furnishing in accordance with some embodiments of the present invention.

The extended operating position allows for active use of the firearm storage furnishing system as shown in FIG. 4. The folded operating position allows for passive storage of the firearm storage furnishing system when not in active use. Specifically, the folded operating position allows the firearm storage furnishing system to take a smaller form factor which is conducive to passive storage in small spaces that may be substantially planar in dimension.

Figure 3C:
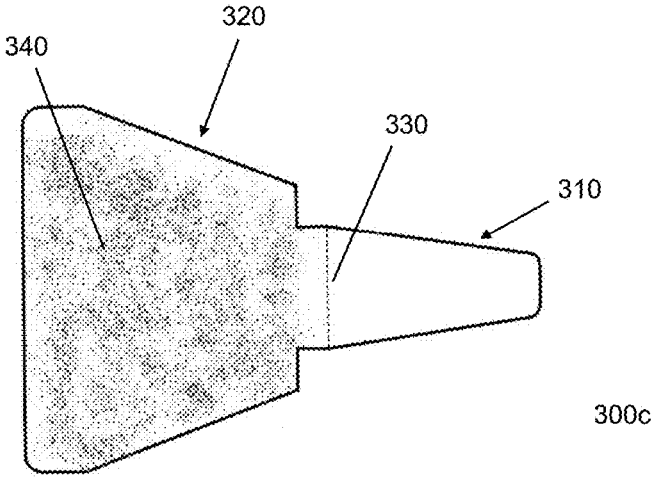
FIG. 3C illustrates a plan view of a firearm storage furnishing system comprising high friction material disposed thereon in accordance with some embodiments of the present invention.

As shown in FIG. 3C, a plan view of a firearm storage furnishing system 300C comprising high friction material 340 disposed thereon is provided. The firearm storage furnishing system 300*c* may comprise a coupling portion 310 fabricated adjacent to a base portion 320 via an angled joint 330. The coupling portion 310 may be secured to the base portion 320 such that each portion 310, 320 may rotate relative one another. In this embodiment, high friction material 340 may be disposed upon a bottom exterior surface of the base portion 320.

The high friction material 340 may comprise any material having a high coefficient of friction with common furnishing fabrics. Such high coefficient of friction materials may include, but are not limited to, diamond particles, silicon carbide particles, rubber, hook and loop fasteners and the like. The coupling portion 310 and base portion 320 may be fabricated out of any suitable robust rigid material such as, but not limited to, light gauge powder coated metal, steel alloys, aluminum, robust polymers and the like or any combination thereof. Therefore, diamond or silicon carbide particles may be applied to the base portion 320 via an electroless plating technique or the like while the rubber or hook and loop fastener material may be applied to the base portion 320 via adhesion or similar bonding.

Utilizing a high friction material 340 upon the bottom exterior surface of the base portion 320 ensures that the force applied to remove the firearm 250 of FIG. 2 from the coupling portion 310 doesn't instead remove the entirety of the firearm storage furnishing system 300*c* from the associated furnishing with the firearm 250 still attached to the coupling portion 310. Encountering such a scenario during an intruder emergency may place the individual in danger and at risk of bodily harm or death.

Therefore, it would be advantageous to utilize the high friction material 340 at least on the bottom exterior surface of the base portion 320 in order to keep the firearm storage furnishing system 300*c* secured within the furnishing while the individual applies force to remove the firearm 250 from the magnetic coupling element 240 of the coupling portion 310. Alternatively, the high friction material 340 may be disposed upon the top exterior surface of the base portion 320 in order to similarly retain the firearm storage furnishing system 300*c* against the furnishing surfaces.

Further, it follows that both the top and bottom exterior surfaces of the base portion 320 may comprise high friction material 340 disposed thereupon to provide an even higher likelihood that the firearm storage furnishing system 300*c* remains secured between the furnishing surfaces while the individual applies rapid removal force to the firearm 250 away from the coupling portion 310. During an intruder emergency event, the individual is likely to apply excess force in removing the firearm 250 from the coupling portion 310 given the excess danger posed to the individual by the intruder and the associated adrenaline rush that comes with rapidly responding to such a surprise occurrence.

It would not be advantageous to utilize the high friction material 340 upon the coupling portion 310 given the high abrasive damage that could result from the individual iteratively securing and removing the firearm 250 to and from the coupling portion 310 exterior surface. Such aesthetic and/or structural damage done to the firearm 250 would deter an individual from using the firearm storage furnishing system 300*c* or at least would require careful removal of the firearm 250 from the coupling portion 310 and thereby place the individual's safety at risk in the event of an intruder emergency.

As shown in FIG. 4, an overview of a firearm storage furnishing system 400 retaining a firearm 450 while secured between a bottom furnishing portion 460 and a top furnishing portion 470 is provided. The firearm storage furnishing system 400 may comprise a coupling portion 410 fabricated adjacent to a base portion 420 via an angled joint 430. The coupling portion 410 may be secured to the base portion 420 such that each portion 410, 420 may rotate relative one another. Alternatively, the coupling portion 410 may be secured to the base portion 420 such that each portion 410, 420 may be permanently affixed at a single angle relative one another.

In use, the firearm storage furnishing system 400 may be secured between one or more portions of a furnishing article. Specifically, the base portion 420 may be inserted between a bottom furnishing portion 460 and a top furnishing portion 470, thereby allowing the coupling portion 410 to project upwards along the top furnishing portion 470 via the angled joint 430. This provides an individual the ability to grasp the handle of the firearm 450 and remove it from the magnetic coupling element 440 of the coupling portion 410.

In one example, the individual may be laying upon a top surface of the top furnishing portion 470. The individual may insert the base portion 420 between the bottom furnishing portion 460 and the top furnishing portion 470. Thereafter the individual may place the firearm 450 in proximity to the magnetic coupling element 440 and in parallel to the plane of the coupling portion 410 as illustrated in FIG. 4. In this configuration, the coupling portion 410 may be disposed parallel to a side surface of the furnishing article thereby allowing the individual laying upon the top surface of the furnishing article to reach for the firearm 450 while laying down and apply force thereto in a direction parallel to the plane of the coupling portion 410 in order to remove the firearm 450 therefrom.

The one or more high friction materials 340 of FIG. 3C would be advantageous to apply to either top or bottom surfaces of the base portion 420 in this configuration. Specifically, the high friction material 340 allows the firearm storage furnishing system 400 to remain secured between bottom and top furnishing portions 460, 470 by creating friction between the material 340 and one or more of the bottom and top portions 460, 470. Application of this material 340 upon the base portion 420 allows the individual to apply force in a rapid uncalculated manner without creating the risk of pulling out the entirety of the firearm storage furnishing system 400 from the furnishing article while rapidly drawing the firearm 450 from the coupling portion 410 during an intruder emergency event.

Additionally, in some embodiments, a firearm holster may be utilized in combination with the firearm 450. In such a configuration, the magnetic coupling element 440 may comprise a strong enough vertical pulling force so as to allow the firearm 450 to couple to the coupling portion 410 despite the introduction of an air gap from the presence of the holster wall thickness. Alternatively, the firearm holster itself may comprise a material that is compatible for coupling with the magnetic coupling element 440 itself thereby allowing the firearm 450 to be withdrawn directly from the affixed holster.

Figure 5:
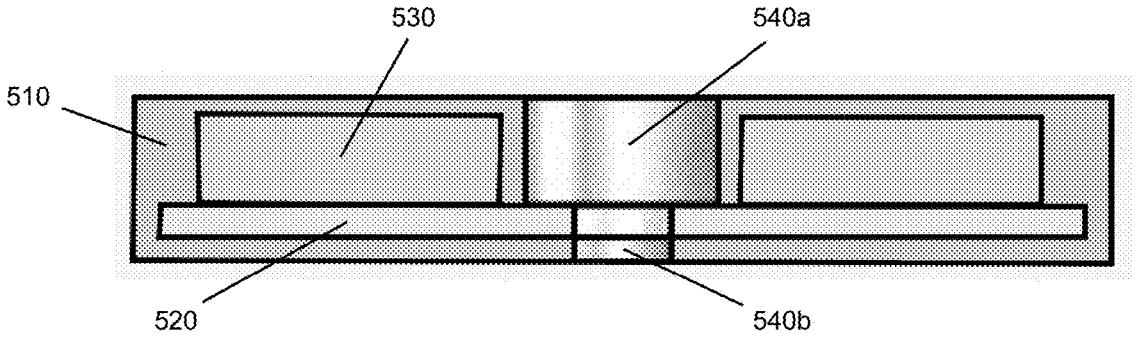
FIG. 5 illustrates a cross-sectional view of a magnetic coupling element of a firearm storage furnishing system in accordance with some embodiments of the present invention.

As shown in FIG. 5, a cross-sectional view of a magnetic coupling element 500 of a firearm storage furnishing system illustrated in FIGS. 1-4. The magnetic coupling element 500 may comprise a protective exterior coating 510, a support substrate 520, a magnet 530 and a central aperture 540 having an exterior aperture 540*a* and an interior aperture 540*b*. The magnetic coupling element 500 as a whole may take any suitable shape such as cylindrical, rectangular, hexagonal and the like. Further, the magnetic coupling element 500 may be set into a similarly shaped recess within a coupling portion of the firearm storage furnishing system such that the magnetic coupling element 500 is set flush with the exterior surface of the coupling portion. Preferably, a cylindrical or rectangular shape may be selected for the magnetic coupling element 500 due to the reduced cost of fabricating the recess within the coupling portion of the firearm storage furnishing system.

Specifically, the support substrate 520 may retain the magnet 530 thereupon with the protective exterior coating 510 encapsulating both the support substrate 520 and the magnet 530 as illustrated in FIG. 5. The central aperture 540 may be disposed through each of the protective exterior coating 510, support substrate 520 and the magnet 530. Further, the central aperture 540 may comprise the exterior aperture 540*a* disposed at an exterior portion of the magnetic coupling element 500 and extending through the magnet 530. Similarly, the central aperture 540 may comprise the interior aperture 540*b* disposed at an interior portion of the magnetic coupling element 500 and extending through the support substrate 520.

Additionally, the diameter of the exterior aperture 540*a* may be dimensionally 1.5 to 2.5 times larger than that of the interior aperture 540*b* in order to accommodate a fastening element therein that comprises a head portion and a shaft portion which fastens the magnetic coupling element 500 within the recess of the coupling portion. Upon fastening the magnetic coupling element 500 within the recess by inserting the fastening element within the central aperture 540, the exterior surface of the fastening element may sit below the exterior surface of the surrounding protective exterior coating 510 as defined by the exterior aperture 540*a*. This configuration allows a firearm to be magnetically coupled to the magnetic coupling element 500 without being scratched or experiencing abrasion from the fastening element, thereby providing a very advantageous feature.

In some embodiments illustrated in FIGS. 1-5, the coupling portion and the base portion may be affixed to one another via an angled joint at an angle of between 80 degrees and 100 degrees. Preferably, the angled joint is set at an angle of between 85 degrees and 95 degrees, but more preferably set at an angle at approximately 90 degrees. While 90 degrees is more preferred, any range of angles between 80 degrees and 100 degrees would allow for the base portion to be secured horizontally between two furnishing portions while allowing for the coupling portion to be secured substantially vertically (e.g. between 80 degrees and 100 degrees relative the base portion) adjacent the top furnishing as illustrated in FIG. 4 which presents the user with a large surface area of the firearm handle to grasp while using the furnishing.

In some embodiments illustrated in FIGS. 1-5, the magnetic coupling element may comprise a surface area of at least 1 square inch, but more preferably of at least 1.5 square inches. While at least 1.5 square inches is more preferable, a magnetic coupling element having at least 1 square inch would allow for a firearm of typical form factor to be coupled to the magnetic coupling element without allowing for unintended rotation of the firearm about the surface of the magnetic coupling element. In other words, the smaller the surface area of the magnetic coupling element, the greater the rotational freedom of the firearm coupled thereto. However, a magnetic coupling element of too large a surface area would be economically unfeasible to manufacture.

In some embodiments illustrated in FIGS. 1-5, the magnet contained within the magnetic coupling element may provide an orthogonal pulling force that creates a frictional force of at least 3 pounds between the magnetic coupling element and a firearm exterior surface when the magnetic coupling element is oriented vertical relative to a ground surface orientation. Assuming the magnetic coupling element is oriented roughly orthogonal to a ground surface and thereby parallel relative the vector of gravitational force, a frictional force of at least 3 pounds between the magnetic coupling element and the firearm exterior surface will prevent the firearm from decoupling from the magnetic coupling element. Given the average weight of a loaded handgun is between 1.5 pounds and 2.5 pounds, it is therefore advantageous that the frictional force be at least 3 pounds to account for variation in the shape and coupling position of the firearm to the magnetic coupling element.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A firearm storage furnishing system, comprising:

a substrate body having a rigid planar coupling portion and a rigid planar base portion that are orthogonally affixed to one another via an angled joint, wherein:

the rigid planar coupling portion comprises a smaller surface area than the rigid planar base portion, the rigid planar base portion comprises a distal end, a proximal end, a first side and a second side, wherein the first side and the second side taper inwards from the distal end to the proximal end, the rigid planar base portion is coupled only to the rigid planar coupling portion, and the angled joint is structurally unitary and monolithic with the rigid planar coupling portion and the rigid planar base portion; and the rigid planar coupling portion comprises a magnetic coupling element disposed at a central area of the rigid planar coupling portion, wherein the magnetic coupling element comprises:

a protective exterior coating;

a support substrate;

a magnet; and a central aperture.

2. The firearm storage furnishing system of claim 1, wherein the magnetic coupling element comprises a planar shape with a surface area of at least 1 square inch.

3. The firearm storage furnishing system of claim 1, wherein the magnet comprises an orthogonal pulling force of between 25 pounds and 40 pounds.

4. The firearm storage furnishing system of claim 1, wherein the magnet comprises an orthogonal pulling force that creates a frictional force of at least 3 pounds between the magnetic coupling element and a firearm exterior surface when the magnetic coupling element is oriented vertical relative a ground surface.

5. The firearm storage furnishing system of claim 1, wherein the magnet is fabricated from one or more materials including iron, aluminum, nickel, cobalt, samarium, dysprosium, neodymium, boron, strontium, barium, praseodymium, hafnium, zirconium and any combinations thereof.

6. The firearm storage furnishing system of claim 1, wherein the central aperture is disposed through the protective exterior coating, the support substrate and the magnet.

7. The firearm storage furnishing system of claim 6, wherein the central aperture comprises an exterior aperture portion having a diameter larger than a diameter of an interior aperture portion of the central aperture.

8. The firearm storage furnishing system of claim 1, wherein:

the rigid planar coupling portion comprises a recess fabricated into an exterior surface thereof, and the recess is shaped to accept the magnetic coupling element therein.

9. The firearm storage furnishing system of claim 8, wherein the magnetic coupling element is secured adjacent the recess via a fastening element disposed into the central aperture.

10. The firearm storage furnishing system of claim 1, wherein the substrate body is fabricated from one or more materials including a powder coated metal, a steel alloy, aluminum, a polymer and any combinations thereof.

11. The firearm storage furnishing system of claim 1, wherein the angled joint is structured with an angle of between 80 degrees and 100 degrees.

12. The firearm storage furnishing system of claim 1, wherein the protective exterior coating comprises one or more materials including polytetrafluoroethylene, polyimide, polyetheretherketone, polyphenylensulfide, nylon, acetal, rubber, polyester and any combinations thereof.

13. The firearm storage furnishing system of claim 1, wherein the rigid planar base portion and the rigid planar coupling portion each comprises a convex isosceles trapezoidal shape.

14. The firearm storage furnishing system of claim 1, wherein the ratio of the surface area of the base portion to the surface area of the coupling portion is between 1.5 and 2.5.

15. The firearm storage furnishing system of claim 1, wherein the magnetic coupling element is embedded below an outer surface of the rigid planar coupling portion.

16. The firearm storage furnishing system of claim 1, wherein the magnetic coupling portion element is movable across a surface of the rigid planar coupling portion.

17. The firearm storage furnishing system of claim 1, wherein the angled joint comprises a hinge that rotates through an angle of at least 90 degrees.

18. The firearm storage furnishing system of claim 1, wherein the rigid planar base portion comprises one or more high-friction materials disposed upon an exterior surface thereof.

19. A firearm storage furnishing system, comprising:

a substrate body having a rigid planar coupling portion and a rigid planar base portion that are orthogonally affixed to one another via an angled joint, wherein:

the rigid planar coupling portion comprises a smaller surface area than the rigid planar base portion, the rigid planar base portion comprises a distal end, a proximal end, a first side and a second side, wherein the first side and the second side taper inwards from the distal end to the proximal end, the rigid planar base portion is coupled only to the rigid planar coupling portion, and the angled joint is structurally unitary and monolithic with the rigid planar coupling portion and the rigid planar base portion; and the rigid planar coupling portion comprises a magnetic coupling element disposed at a central area of the rigid planar coupling portion, wherein the magnetic coupling element comprises:

a protective exterior coating;

a support substrate;

a magnet comprising an orthogonal pulling force of between 25 pounds and 40 pounds; and a central aperture disposed through the protective exterior coating, the support substrate and the magnet.

20. A firearm storage furnishing system, comprising:

a substrate body having a rigid planar coupling portion and a rigid planar base portion that are orthogonally affixed to one another via an angled joint at an angle of between 80 degrees and 100 degrees, wherein:

the rigid planar coupling portion comprises a smaller surface area than the rigid planar base portion, the rigid planar base portion comprises a distal end, a proximal end, a first side and a second side, wherein the first side and the second side taper inwards from the distal end to the proximal end, the rigid planar base portion is coupled only to the rigid planar coupling portion, and the angled joint is structurally unitary and monolithic with the rigid planar coupling portion and the rigid planar base portion; and the rigid planar coupling portion comprises a magnetic coupling element disposed within an outer surface of the rigid planar coupling portion and at a central area of the rigid planar coupling portion, wherein the magnetic coupling element comprises:

a protective exterior coating fabricated from one or more materials including polytetrafluoroethylene, polyimide, polyetheretherketone, polyphenylensulfide, nylon, acetal, rubber, polyester and any combinations thereof;

a support substrate fabricated from one or more materials including a powder coated metal, a steel alloy, aluminum, a polymer and any combinations thereof;

a magnet comprising an orthogonal pulling force of between 25 pounds and 40 pounds; and a central aperture disposed through the protective exterior coating, the support substrate and the magnet, wherein the central aperture comprises an exterior aperture portion having a diameter greater than a diameter of an interior aperture portion of the central aperture.

* * * * *